US005377771A

United States Patent [19]

Wenzel

[11] Patent Number: 5,377,771

[45] Date of Patent: Jan. 3, 1995

[54] SEALED BEARING ASSEMBLY USED IN EARTH DRILLING

[75] Inventor: Kenneth H. Wenzel, Edmonton, Canada

[73] Assignee: Vector Oil Tool Ltd., Canada

[21] Appl. No.: 153,524

[22] Filed: Nov. 16, 1993

[51] Int. Cl.[6] ..... E21B 4/02

[52] U.S. Cl. ..... 175/107; 175/228; 384/139

[58] Field of Search ..... 175/107, 228; 384/139, 384/142, 143; 415/903

[56] References Cited

U.S. PATENT DOCUMENTS

| | | | |
|---|---|---|---|
| 3,866,988 | 2/1975 | Striegler | 175/107 X |
| 3,971,450 | 7/1976 | Fox | 175/107 |
| 4,019,591 | 4/1977 | Fox | 175/107 |
| 4,114,702 | 9/1978 | Maurer | 175/107 |
| 4,114,703 | 9/1978 | Matson, Jr. et al. | 175/107 |
| 4,114,704 | 9/1978 | Maurer et al. | 175/107 |
| 4,260,167 | 4/1981 | Fox | 175/107 X |
| 4,284,149 | 8/1981 | Fox | 175/228 X |
| 4,324,299 | 4/1982 | Nagel | 175/107 |
| 4,329,127 | 5/1982 | Tschirky et al. | 175/107 X |
| 4,361,194 | 10/1982 | Chow et al. | 175/102 |
| 4,410,054 | 10/1983 | Nagel et al. | 175/107 |
| 4,476,944 | 10/1984 | Beimgraben | 175/107 X |
| 4,577,704 | 3/1986 | Aumann | 175/107 |
| 4,593,774 | 6/1986 | Lingafelter | 175/107 |
| 4,620,601 | 11/1986 | Nagel | 175/107 |
| 4,683,964 | 8/1987 | Wenzel | 175/107 |
| 4,772,246 | 9/1988 | Wenzel | 464/117 |
| 5,067,874 | 11/1991 | Foote | 415/903 X |
| 5,217,080 | 6/1993 | Wenzel et al. | 175/107 |

*Primary Examiner*—Hoang C. Dang

*Attorney, Agent, or Firm*—Davis, Bujold & Streck

[57] ABSTRACT

A sealed bearing assembly used in earth drilling is described having a first tubular member and a second tubular member telescopically received in the first tubular member. The second tubular member has an interior passage through which drilling fluids pass under pressure from surface pumps. A clearance space is provided between the first tubular member and the second tubular member defining a lubricant filled sealed chamber. The sealed chamber has a bit end sealed by a bit end seal which faces a drill bit and a pump end sealed by a pump end seal which faces surface pumps. A fixed mechanical seal is disposed in the sealed chamber intermediate the pump end seal and the drill bit end seal. The mechanical seal divides the sealed chamber into a pump end portion and a drill bit end portion. The pump end seal is responsive to pressure exerted by drilling fluids pumped along the interior passage by surface pumps. The drill bit end seal is responsive to pressure exerted by drilling fluids flowing externally to the first tubular member and the second tubular member. The mechanical seal seals a pressure differential between the pump end portion and the drill bit end portion of the sealed chamber.

13 Claims, 3 Drawing Sheets

SEALED BEARING ASSEMBLY USED IN EARTH DRILLING

The present invention relates to a sealed bearing assembly used in earth drilling.

BACKGROUND OF THE INVENTION

U.S. Pat. No. 5,217,080, entitled "Sealing System for a Sealed bearing assembly" which issued to Kenneth Hugo Wenzel and Dean Foote on Jun. 8, 1993 discloses a sealed bearing assembly for use in earth drilling in which the pressure drop across the bit due to jetting is sealed by a centrally positioned mechanical seal. This is accomplished by having a lubricant filled first chamber above the mechanical seal pressurized by a floating piston and a second chamber below the mechanical seal in communication the annulus such that drilling fluids from exterior of the tool enter the second chamber. A second floating piston is in communication with drilling fluids in the second chamber and provides pressure balancing to equalize pressure in a sealed chamber sealed at a lower or bit end by a fixed seal.

U.S. Pat. No. 5,217,080 while representing an advance over the prior art has two inherent disadvantages. One disadvantage is that according to its teachings corrosive drilling fluids are allowed to enter into the interior of the tool. The presence of corrosive drilling fluids requires that the exposed components be specially treated or made of corrosion resistant materials such as stainless steel. Another disadvantage is the length of the tool. In directional drilling, it is desirable to have the downhole drilling motor assembly as short as possible in order to facilitate making tight radiused turns to "build angle" as rapidly as possible.

SUMMARY OF THE INVENTION

What is required is a sealed bearing assembly for use in earth drilling which overcomes the described disadvantages.

According to the present invention there is provided a sealed bearing assembly used in earth drilling having a first tubular member and a second tubular member telescopically received in the first tubular member. The second tubular member has an interior passage through which drilling fluids pass under pressure from surface pumps. A clearance space is provided between the first tubular member and the second tubular member defining a lubricant filled sealed chamber. The sealed chamber has a bit end sealed by bit end sealing means which face a drill bit and a pump end sealed by pump end sealing means which face surface pumps. Bearing means are disposed within the sealed chamber. The sealed bearing assembly is characterized by a fixed mechanical seal disposed in the sealed chamber intermediate the pump end sealing means and the drill bit end sealing means. The mechanical seal divides the sealed chamber into a pump end portion and a drill bit end portion. The pump end sealing means are pressure responsive, such that the pump end sealing means exerts a pressure upon lubricant within the pump end portion of the sealed chamber in response to pressure exerted by drilling fluids pumped along the interior passage by surface pumps. The drill bit end sealing means are pressure responsive, such that the drill bit end sealing means exerts a pressure upon lubricant within the drill bit end portion of the sealed chamber in response to pressure exerted by drilling fluids flowing externally to the first tubular member and the second tubular member. The mechanical seal includes means for non-rotatably coupling a first seal ring to the first tubular member. Means is also provided for non-rotatably coupling a second seal ring to he second tubular member. Means is provided to bring the first seal ring and the second seal ring into sealing engagement thereby forming a mechanical seal. The mechanical seal seals a pressure differential between the pump end portion and the rill bit end portion of the sealed chamber.

The sealed bearing assembly, as described, can accomplish the same desirable result as U.S. Pat. No. 5,217,080, but is shorter in length as the second chamber and the second piston are eliminated. Corrosive drilling fluids are not permitted to enter into the interior of the tool and, therefore, special treatment of interior components is not required. Both sides o f the mechanical seal are immersed in a bath of lubricant, which provides a greatly improved operating environment.

There are alternate means for non-rotatably coupling the first seal ring to the first tubular member. The preferred means includes a first annular seal carrier on which the first seal ring is mounted, the first annular seal carrier having a tapered exterior profile which engages a mating tapered profile on the first tubular member to non-rotatably couple the first annular seal carrier with the first tubular member. Similarly, there are alternate means for non-rotatably coupling the second seal ring to the second tubular member. The preferred means includes a second annular seal carrier on which the second seal ring is mounted, the second annular seal carrier being non-rotatably coupled to the second tubular member by means of a taper lock hub or set screws. This combination of the described coupling means makes assembly of the sealed bearing assembly much easier. The first annular seal carrier is slid into the first tubular member until the mating taper engage. The second seal carrier is then slid into the second tubular member until the seal rings are engaged. The taper lock hub is then locked or the set screws tightened.

Although beneficial results may be obtained through the use of the sealed bearing assembly, as described, it is sometimes difficult to get seal carriers machined to provide precise alignment. It is also difficult to maintain alignment of mechanical seals in an environment in which there is continual vibration, and in the face of wear experience over a prolonged period of use. Even more beneficial results may, therefore, be obtained when each of the first annular seal carrier and the second annular seal carrier include a first portion and a second portion. A plurality of axially extending pins extend between the first portion and the second portion such that the first portion and the second portion are non-rotatably coupled while retaining relative axial movement. A plurality of biasing springs are disposed between the first portion and the second portion. The biasing springs serve as the means to bring the first seal ring and the second seal ring into sealing engagement.

Although beneficial results may be obtained through the use of the sealed bearing assembly, as described, the practice with directional drilling is to steer the lower end of the drill string. When such steering occurs the entire drill string, including an angular offset portion at the lower end of the drill string, is rotated in the hole. The rotation of the lower portion having an angular offset causes tremendous side loading which can cause the sealed bearing assembly to break at any structurally weak points. It is, therefore, of importance to have the first tubular member and the second tubular member as stiff as possible. Even more beneficial results may, therefore, be obtained when the bearing means including a plurality of bushings adapted to receive radial loading disposed between the first tubular member and the second tubular member.

The use of bushings as the form of radial load bearing in combination with the intermediate positioning of the mechanical seal permits the thickness of the first tubular member and the second tubular member to be increased. Relatively small increases in thickness of these components result in exponential increases in stiffness, and make a significant difference.

Although beneficial results may be obtained through the use of the sealed bearing assembly, as described, thermal expansion of fluids during downhole operation and operational leakage through the mechanical seal will result in a pressure increase within the drill bit portion of the sealed chamber. Although a slight positive pressure is beneficial, it is undesirable to have an excessive positive pressure. Even more beneficial results may, therefore, be obtained when the drill bit portion of the sealed chamber has pressure relief means through which excess fluid is bled to the exterior of the first tubular member upon the pressure of fluid within the drill bit portion of the sealed chamber exceeding a predetermined level.

There are two preferred forms of pressure relief means. The first form of pressure relief means includes a fluid bleed off passage extending from the drill bit portion of the sealed chamber through the first tubular member. The fluid bleed off passage has an "O" ring seal circumscribing the first tubular member. The "O" ring seal is positioned in a tapered groove transverse to the fluid bleed off passage. The "O" ring seal blocks the flow of fluids through the fluid bleed off passage until fluids exert sufficient pressure to force the "O" ring partially up the tapered groove and bleed past the "O" ring seal.

This form of pressure relief means has a number of advantages. It is relatively inexpensive, and can be accommodated within the limited space that this application demands. With the first form of pressure relief means, the preferred taper for the seal groove that accommodates the "O" ring seal is approximately 15 degrees. It would be undesirable to have a washing action created by drilling fluids flowing up the annulus dislodge the "O" ring seal. It is, therefore, preferred that the protective shroud overly the "O" ring seal. The protective shroud has a plurality of outlets to exterior of the first tubular member.

The second form of pressure relief involves intentionally designing the drill bit end sealing means so that liquid can leak from the interior to the exterior at a predetermined pressure. The pressure responsive drill bit end sealing means includes seals disposer in seal grooves with stepped seal engaging end walls. The seals leak fluids past the stepped end walls of the seal grooves to the exterior of the first tubular member at predetermined pressure levels.

BRIEF DESCRIPTION OF THE DRAWINGS

These and other features of the invention will become more apparent from the following description in which reference is made to appended drawings wherein.

DETAILED DESCRIPTION OF THE PREFERRED EMBODIMENT

Figure 1A:
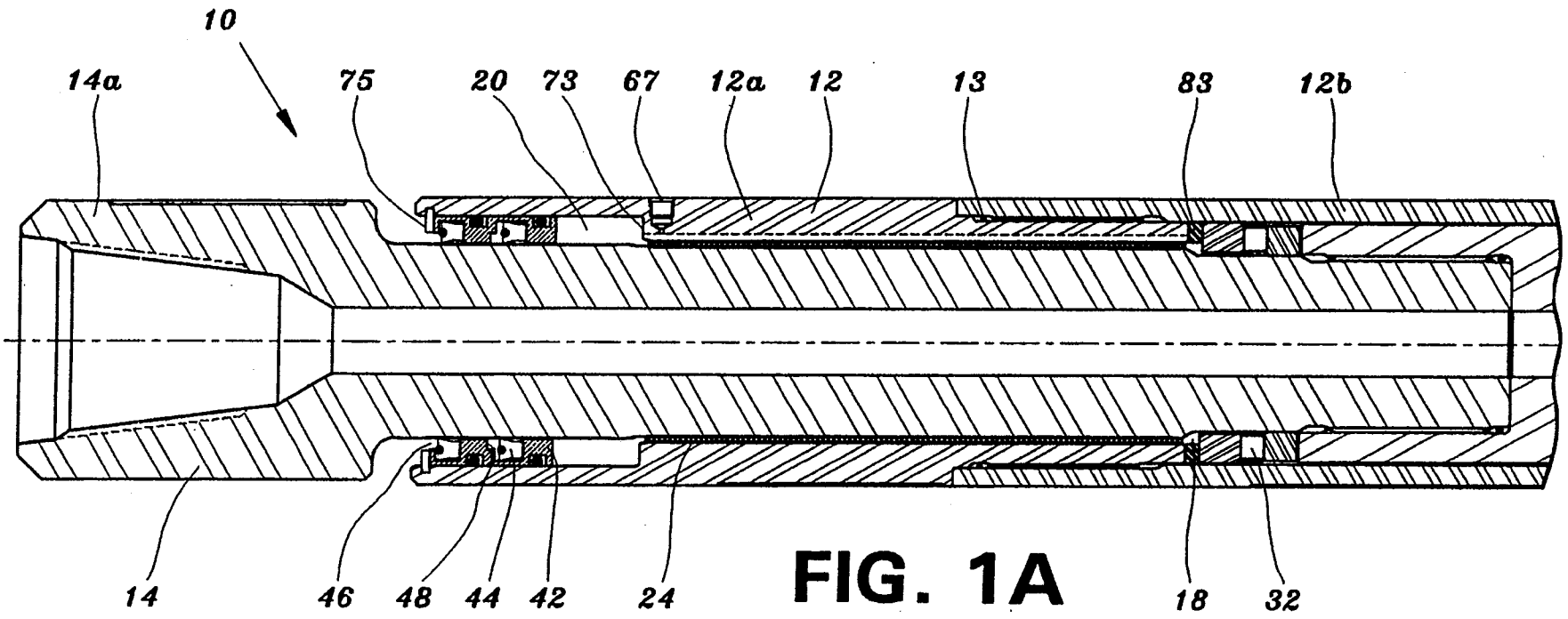
FIGS. 1*a* and 1*b* are side elevation views in longitudinal section of a sealed bearing assembly constructed in accordance with the teachings of the present invention.
Figure 1B:
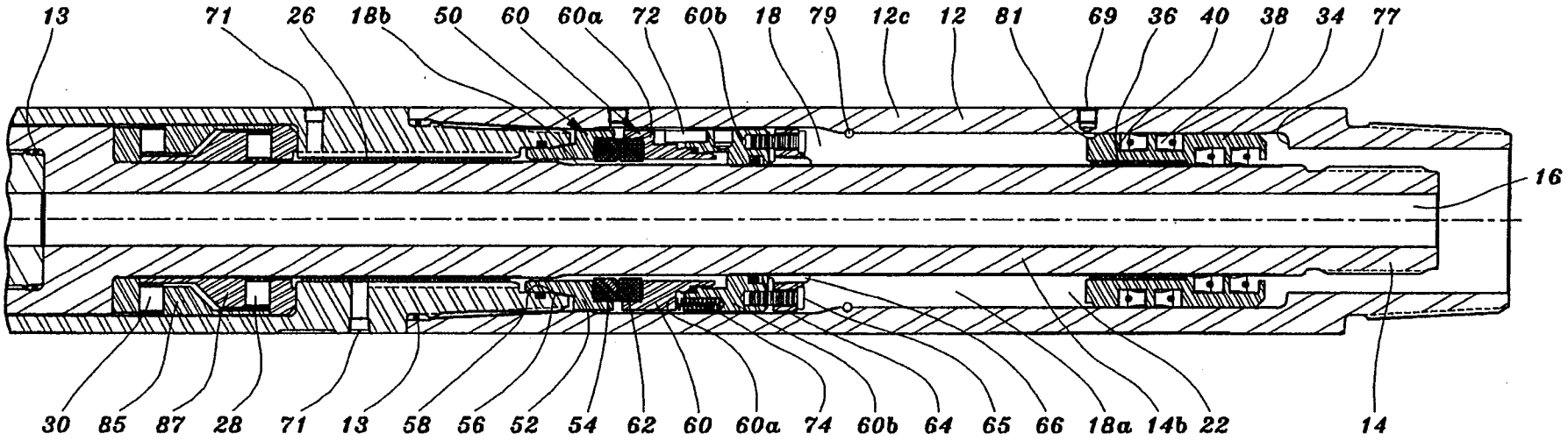
Figure 2:
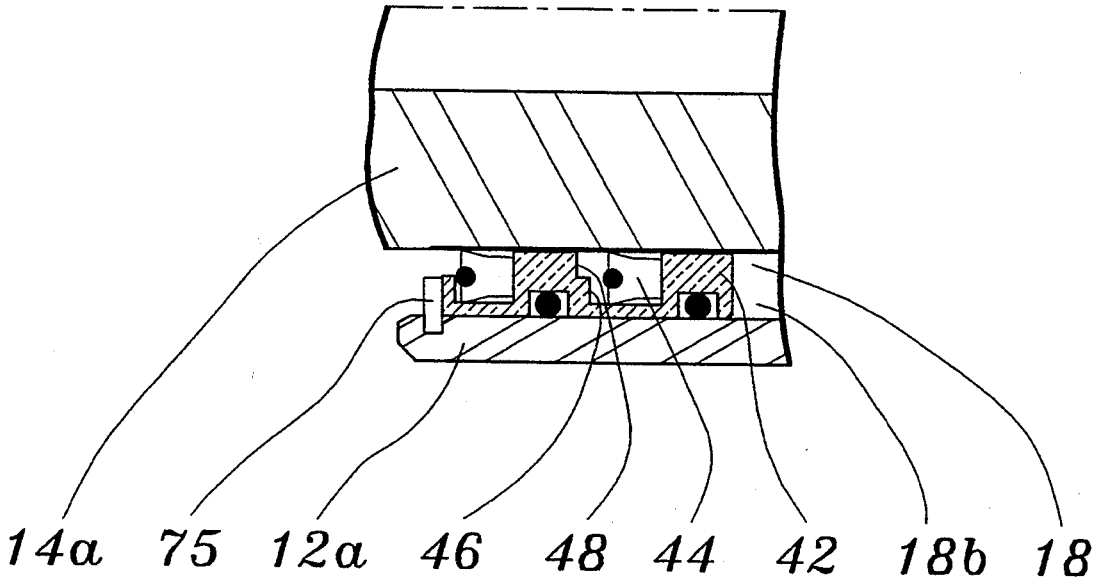
FIG. 2 is a detailed side elevation view in longitudinal section of pressure relief means illustrated in FIG. 1.

The preferred embodiment, a sealed bearing assembly generally identified by reference numeral 10, will now be described with reference to FIGS. 1*a* through 3.

Sealed bearing assembly 10 has a first tubular member 12 and a second tubular member 14 telescopically received in first tubular member 12. For ease of assembly first tubular member 12 is divided into a plurality of sections; a bearing housing section 12*a*, a thrust housing section 12*b*, and a piston housing section 12*c*. Similarly, second tubular member is divided into a plurality of sections; a bearing mandrel section 14*a* and a piston mandrel section 14*b*. The connection between each section is sealed by "O" ring seals 13. Second tubular member 14 has an interior passage 16 through which drilling fluids pass under pressure from surface pumps (not shown). A clearance space between first tubular member 12 and second tubular member 14 defines a sealed lubricant filled chamber 18. Sealed chamber 18 has a bit end 20 which faces the drill bit (not shown) and a pump end 22 which faces surface pumps (not shown). A plurality of bearings are disposed within sealed chamber 18. These bearings include bushings 24 and 26 disposed between first tubular member 12 and second tubular member 14 to bear radial loads. There are also a plurality of bearings 28, 30 and 32 disposed between first tubular member 12 and second tubular member 14 adapted to bear axial loads. An annular pressure responsive pump end seal carrying piston 34 is positioned at pump end 22 of sealed chamber 18. Pump end piston 34 has a bushing 36, and a plurality of floating seals 38 contained in seal grooves 40. Pump end piston 34 is in communication with drilling fluids passing along interior passage 16. An annular pressure responsive drill bit end seal carrying piston 42 is positioned at drill bit end 20 of sealed chamber 18. Drill bit end piston 42 has a plurality of floating seals 44 contained in seal grooves 46. It is important to note that seal grooves 46 that have stepped seal engaging end walls 48, this provides a means of pressure relief as will be further described with respect to FIG. 2 and in relation to operation of sealed bearing assembly 10. A fixed mechanical seal generally identified by reference numeral 50 is disposed in sealed chamber 18 intermediate pump end piston 34 and drill bit end piston 42. Mechanical Seal 50 divides sealed chamber into a pump end portion 18*a* and a drill bit end portion 18*b*. Pump end piston 34 exerts a pressure upon lubricant within pump end portion 18*a* of sealed chamber 18 in response to pressure exerted by drilling fluids pumped along interior passage 16 by surface pumps. Drill bit end piston 42 exerts a pressure upon lubricant within drill bit end portion 18*b* of sealed chamber 18 in response to pressure exerted by drilling fluids flowing externally to first tubular member 12. Mechanical seal 50 includes a first annular seal carrier 52 on which a first seal ring 54 is mounted. First annular seal carrier 52 has a tapered exterior profile 56 which engages a mating tapered interior profile 58 on first tubular member 12 to non-rotatably couple first annular seal carrier 52 with first tubular member 12. A second annular seal carrier assembly 60 is provided upon which a second seal ring 62 is mounted. Second annular seal carrier assembly 60 includes a first portion 60*a* and a second portion 60*b*. A plurality of axially extending pins 72 extend between first portion 60*a* and second portion 60*b* such that first portion 60*a* and second portion 60*b* are non-rotatably coupled while retaining relative axial movement. A plurality of biasing springs 74 are disposed between first portion 60*a* and second portion 60*b*. Biasing springs 74 serve to maintain second seal ring 62 in sealing engagement with first seal ring 54. Second annular seal carrier assembly 60 also includes a tapered locking hub 64 which is attached to second portion 60*b* of second annular seal carrier 60 by means of set screws 65. Tapered locking hub 64 has an interior profile 66 which engages second tubular member 14 to non-rotatably couple second annular seal carrier assembly 60 with second tubular member 14. It can be seen from this description that first annular seal carrier 52 rotates with first tubular member 12 and second annular seal carrier assembly 60 rotates with second tubular member 14. A number of passages 67, 69, 71 are provided through first tubular member 12 for the purpose of filling sealed chamber 18 with lubricant. Once sealed chamber has been filled with lubricant, passages 67, 69, and 71 are closed with plugs (not shown). The travel of drill bit end piston 42 is confined between a shoulder 73 and a snap ring 75. The travel of pump end piston 34 is confined between a shoulder 77 and a stop ring 79 which engages a groove 81 in pump end piston 34. Bearing 32 is an "off-bottom bearing that bears axial loads when the drill bit is lifted placing sealed bearing assembly 10 in tension. The axial movement of second tubular member 14 prior to engaging bearing 32 is regulate by means of a spacer shim 83. Axial loading when sealed bearing assembly is in compression is distributed evenly between bearings 28 and 30 by means of spacer elements 85 and 87.

Figure 3:
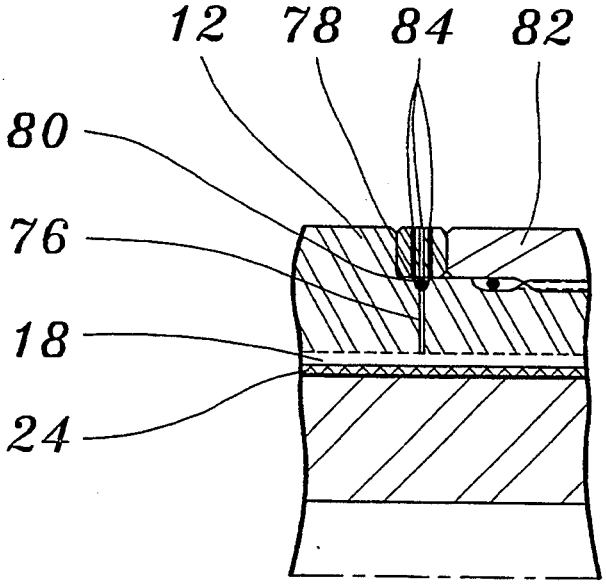
FIG. 3 is a detailed side elevation view in longitudinal section of an alternate form of pressure relief means.

Referring to FIG. 3, there illustrated an alternative form of pressure relief means which includes a fluid bleed off passage 76 extending from drill bit portion 18*b* of sealed chamber 18 transversely through first tubular member 12. Fluid bleed off passage 76 has an "O" ring seal 78 circumscribing first tubular member 12. "O" ring seal 78 is positioned in a tapered groove 80 transverse to fluid bleed off passage 76. "O" ring seal 78 blocks the flow of fluids through fluid bleed off passage 76 until fluids exert sufficient pressure to force "O" ring 78 partially up tapered groove 80 and bleed past "O" ring seal 78. A protective shroud 82 overlies "O" ring seal 78. Protective shroud 82 has a plurality of outlets 84 to exterior of first tubular member 12.

The use and operation of sealed bearing assembly 10 will now be described with reference to FIGS. 1*a* through 3. Drilling fluids are pumped by surface pumps down interior passage 16. A portion of the drilling fluid from interior passage 16 is diverted to pump end piston 34. Pump end piston 34 moves in response to the pressure exerted by the drilling fluid placing lubricant in pump end portion 18*a* of sealed chamber 18 under like pressure. The drilling fluids generally follow a path down interior passage 16 to the drill bit (not shown) and then up the annular exterior of first tubular member 12. As drilling fluids travel up the annulus exterior of first tubular member 12 a portion of the flow is diverted to drill bit end piston 42. Drill bit end piston 42 moves in response to pressure exerted by the drilling fluid placing lubricant in drill bit end portion 18*b* of sealed chamber 18 under like pressure. There is usually a pressure differential between pump pressure exerted by surface pumps upon drilling fluids flowing down interior passage 16 and annular pressure of drilling fluids flowing exterior of first tubular member 12. This differential in pressure results in a differential in pressure between lubricant in pump end portion 18*a* and drill bit end portion 18*b* of sealed chamber 18, which is sealed by mechanical seal 50. During normal operation of mechanical seal 50 some lubricant will leak from pump end portion 18*a* which serves as a lubricant reservoir for mechanical seal 50 to drill bit end portion 18*b*. This leakage, together with thermal expansion, can result in an increase in the pressure within drill bit end portion 18*b* of sealed chamber 18. If the pressure within drill bit end portion 18*b* of sealed chamber 18 should rise above a predetermined level pressure relief means is provided in drill bit end piston 42, through which excess lubricating fluid is bled from drill bit end portion 18*b* to exterior of first tubular member 12. As previously described, pressure responsive drill bit end piston 42 includes seals 44 disposed in seal grooves 46. Seal grooves 46 have stepped seal engaging end walls 48. As pressure increases within drill bit end portion 18*b* of sealed chamber 18, seals 44 are forced into increasing engagement with end walls 48. However, due to the stepped nature of end wall 8 a portion of seal 44 is not supported. The stepped portion of end wall 48 accommodates some movement of seal 44 if the pressure is great enough to deform seal 44. Upon the pressure in drill bit end 18*b* of sealed chamber 18 exceeding a predetermined level seal 44 deforms to enable fluids to leak to exterior of first tubular member 12.

FIG. 3 illustrates an alternative form of pressure relief which could be utilized. When the pressure in drill bit end 18*b* of sealed chamber 18 increases above a predetermined level lubricating fluids in drill bit end 18*b* of sealed chamber 18 flow along fluid bleed off passage 76 and exert sufficient pressure to force "O" ring 78 partially up tapered groove 80. The movement of "O" ring 78 enables fluids to bleed past "O" ring seal 78 and out to exterior of first tubular member 12 through outlets 84 in protective shroud 82. It will be apparent to one skilled in the art that modifications may be made to the illustrated embodiment without departing from the spirit and scope of the invention as defined by the claims.

The embodiments of the invention in which an exclusive property or privilege is claimed are defined as follows:

1. A sealed bearing assembly used in earth drilling having a first tubular member, a second tubular member telescopically received in the first tubular member, the second tubular member having an interior passage through which drilling fluids pass under pressure from surface pumps, a clearance space between the first tubular member and the second tubular member defining a sealed lubricant filled chamber, the sealed chamber having a drill bit end sealed by drill bit end sealing means which face a drill bit and a pump end sealed by pump end sealing means which face surface pumps, bearing means being disposed within the sealed chamber, comprising:

a. a fixed mechanical seal disposed in the sealed chamber intermediate the pump end sealing means and the drill bit end sealing means, the mechanical seal dividing the sealed chamber into a pump end portion and a drill bit end portion;

b. the pump end sealing means being pressure responsive, such that the pump end sealing means exerts a pressure upon lubricant within the pump end portion of the sealed chamber in response to pressure exerted by drilling fluids pumped along the interior passage by surface pumps;

c. the drill bit end sealing means being pressure responsive, such that the drill bit end sealing means exerts a pressure upon lubricant within the drill bit end portion of the sealed chamber in response to pressure exerted by drilling fluids flowing externally to the first tubular member and the second tubular member; and d. the mechanical seal comprising:

i. means for non-rotatably coupling a first seal ring to the first tubular member;

ii. means for non-rotatably coupling a second seal ring to the second tubular member; and iii. means to bring the first seal ring and the second seal ring into sealing engagement thereby forming a mechanical seal, the mechanical seal sealing a pressure differential between the pump end portion and the drill bit end portion of the sealed chamber.

2. The sealed bearing assembly as defined in claim 1, wherein the means for non-rotatably coupling the first seal ring to the first tubular member includes a first annular seal carrier on which the first seal ring is mounted, the first annular seal carrier having a tapered exterior profile which engages a mating tapered profile on the first tubular member to non-rotatably couple the first annular seal carrier with the first tubular member.

3. The sealed bearing assembly as defined in claim 1, wherein the means for non-rotatably coupling the second seal ring to the second tubular member includes a second annular seal carrier on which the second seal ring is mounted, the second annular seal carrier having a tapered interior profile which engages a mating tapered profile on the second tubular member to non-rotatably couple the second annular seal carrier with the second tubular member.

4. The sealed bearing assembly as defined in claim 3, wherein the second annular seal carrier includes a first portion and a second portion, a plurality of axially extending pins extending between the first portion and the second portion such that the first portion and the second portion are non-rotatably coupled while retaining relative axial movement, a plurality of biasing spring being disposed between the first portion and the second portion, the biasing springs serving as the means to maintain the second seal ring in sealing engagement with the first sealing ring.

5. The sealed bearing assembly as defined in claim 1, wherein the bearing means includes a plurality of bushings adapted to receive radial loading disposed between the first tubular member and the second tubular member.

6. The sealed bearing assembly as defined in claim 1, wherein the bearing means includes a plurality of bearings adapted to receive axial loading disposed between the first tubular member and the second tubular member.

7. The sealed bearing assembly as defined in claim 1, wherein the drill bit end portion of the sealed chamber has pressure relief means through which excess fluid is bled to the exterior of the first tubular member upon the pressure of fluid within the drill bit end portion of the sealed chamber exceeding a predetermined level.

8. The sealed bearing assembly as defined in claim 7, wherein the pressure relief means includes a fluid bleed off passage extending from the drill bit end portion of the sealed chamber through the first tubular member, the fluid bleed off passage having an "O" ring seal circumscribing the first tubular member, the "O" ring seal being positioned in a tapered groove transverse to the fluid bleed off passage, such that the "O" ring seal blocks the flow of fluids through the fluid bleed off passage until fluids exerting sufficient pressure to force the "O" ring partially up the tapered groove and bleed past the "O" ring seal.

9. The sealed bearing assembly as defined in claim 8, wherein a protective shroud overlies the "O" ring seal, the protective shroud having a plurality of outlets to the exterior of the first tubular member.

10. The sealed bearing assembly as defined in claim 7, wherein the pressure relief means is positioned in the pressure responsive drill bit end sealing means, the pressure responsive drill bit end sealing means including seals disposed in seal grooves that have stepped seal engaging end walls, such that the seals are purposely configured to leak fluids to the exterior of the first tubular member at predetermined pressures.

11. A sealed bearing assembly used in earth drilling having a first tubular member, a second tubular member telescopically received in the first tubular member, the second tubular member having an interior passage through which drilling fluids pass under pressure from surface pumps, a clearance space between the first tubular member and the second tubular member defining a lubricant filled sealed chamber, the sealed chamber having a drill bit end sealed by drill bit end sealing means which face a drill bit and a pump end sealed by pump end sealing means which face surface pumps, bearing means being disposed within the sealed chamber, comprising:

a. a fixed mechanical seal disposed in the sealed chamber intermediate the pump end sealing means and the drill bit end sealing means, the mechanical seal dividing the sealed chamber into a pump end portion and a drill bit end portion;

b. the pump end sealing means being pressure responsive, such that the pump end sealing means exerts a pressure upon lubricant within the pump end portion of the sealed chamber in response to pressure exerted by drilling fluids pumped along the interior passage by surface pumps;

c. the drill bit end sealing means being pressure responsive, such that the drill bit end sealing means exerts a pressure upon lubricant within the drill bit end portion of the sealed chamber in response to pressure exerted by drilling fluids flowing externally to the first tubular member and the second tubular member; and d. the mechanical seal comprising:

i. a first annular seal carrier on which the first seal ring is mounted, the first annular seal carrier having a tapered exterior profile which engages a mating tapered profile on the first tubular member to non-rotatably couple the first annular seal carrier with the first tubular member;

ii. a second annular seal carrier on which the second seal ring is mounted, the second annular seal carrier having a tapered interior profile which engages a mating tapered profile on the second tubular member to non-rotatably couple the second annular seal carrier with the second tubular member;

iii. the second annular seal carrier includes a first portion and a second portion, a plurality of axially extending pins extending between the first portion and the second portion such that the first portion and the second portion are non-rotatably coupled while retaining relative axial movement, a plurality of biasing spring being disposed between the first portion and the second portion, the biasing springs serving as the means to maintain the second seal ring in sealing engagement with the first sealing ring thereby forming a mechanical seal, the mechanical seal sealing a pressure differential between the pump end portion and the drill bit end portion of the sealed chamber; and e. the drill bit end portion of the sealed chamber having pressure relief means through which excess fluid is bled to the exterior of the first tubular member upon the pressure of fluid within the drill bit end portion of the sealed chamber exceeding a predetermined level, the pressure relief means including a fluid bleed off passage extending from the drill bit end portion of the sealed chamber through the first tubular member, the fluid bleed off passage having an "O" ring seal circumscribing the first tubular member, the "O" ring seal being positioned in a tapered groove transverse to the fluid bleed off passage, such that the "O" ring seal blocks the flow of fluids through the fluid bleed off passage until fluids exerting sufficient pressure to force the "O" ring partially up the tapered groove and bleed past the "O" ring seal, a protective shroud overlying the "O" ring seal, the protective shroud having a plurality of outlets to the exterior of the first tubular member.

12. A sealed bearing assembly used in earth drilling having a first tubular member, a second tubular member telescopically received in the first tubular member, the second tubular member having an interior passage through which drilling fluids pass under pressure from surface pumps, a clearance space between the first tubular member and the second tubular member defining a lubricant filled sealed chamber, the sealed chamber having a drill bit end sealed by drill bit end sealing means which face a drill bit and a pump end sealed by pump end sealing means which face surface pumps, bearing means being disposed within the sealed chamber, comprising:

a. a fixed mechanical seal disposed in the sealed chamber intermediate the pump end sealing means and the drill bit end sealing means, the mechanical seal dividing the sealed chamber into a pump end portion and a drill bit end portion;

b. the pump end sealing means being pressure responsive, such that the pump end sealing means exerts a pressure upon lubricant within the pump end portion of the sealed chamber in response to pressure exerted by drilling fluids pumped along the interior passage by surface pumps;

c. the drill bit end sealing means being pressure responsive, such that the drill bit end sealing means exerts a pressure upon lubricant within the drill bit end portion of the sealed chamber in response to pressure exerted by drilling fluids flowing externally to the first tubular member and the second tubular member; and d. the mechanical seal comprising:

i. a first annular seal carrier on which the first seal ring is mounted, the first annular seal carrier having a tapered exterior profile which engages a mating tapered profile on the first tubular member to non-rotatably couple the first annular seal carrier with the first tubular member;

ii. a second annular seal carrier on which the second seal ring is mounted, the second annular seal carrier having a tapered interior profile which engages a mating tapered profile on the second tubular member to non-rotatably couple the second annular seal carrier with the second tubular member;

iii. the second annular seal carrier includes a first portion and a second postion, a plurality of axially extending pins extending between the first portion and the second portion such that the first portion and the second portion are non-rotatably coupled while retaining relative axial movement, a plurality of biasing spring being disposed between the first portion and the second portion, the biasing springs serving as the means to maintain the second seal ring in sealing engagement with the first sealing ring thereby forming a mechanical seal, the mechanical seal sealing the pressure differential between the pump end portion and the drill bit end portion of the sealed chamber; and e. the drill bit end portion of the sealed chamber having pressure relief means through which excess fluid is bled to the exterior of the first tubular member upon the pressure of fluid within the drill bit end portion of the sealed chamber exceeding a predetermined level, the pressure relief means being positioned in the pressure responsive drill bit end sealing means, the pressure responsive drill bit end sealing means including seals disposed in seal grooves that have stepped seal engaging end walls, such that the seals are purposely configured to leak fluids to the exterior of the first tubular member at predetermined pressure levels.

13. A sealed bearing assembly used in earth drilling having a first tubular member, a second tubular member telescopically received in the first tubular member, the second tubular member having an interior passage through which drilling fluids pass under pressure from surface pumps, a clearance space between the first tubular member and the second tubular member defining a lubricant filled sealed chamber, the sealed chamber having a drill bit end sealed by drill bit end sealing means which face a drill bit and a pump end sealed by pump end sealing means which face surface pumps, bearing means being disposed within the sealed chamber, comprising:

a. a fixed mechanical seal disposed in the sealed chamber intermediate the pump end sealing means and the drill bit end sealing means, the mechanical seal dividing the sealed chamber into a pump end portion and a drill bit end portion;

b. the pump end sealing means including a pressure responsive pump end seal carrying piston at the pump end of the sealed chamber, such that the pump end piston exerts a pressure upon lubricant within the pump end portion of the sealed chamber in response to pressure exerted by drilling fluids pumped along the interior passage by surface pumps;

c. the drill bit end sealing means including a pressure responsive drill bit end seal carrying piston at the drill bit end of the sealed chamber, such that the drill bit end piston exerts a pressure upon lubricant within the drill bit portion of the sealed chamber in response to pressure exerted by drilling fluids flowing externally to the first tubular member and the second tubular member;

d. the mechanical seal comprising:

i. a first annular seal carrier on which a first seal ring is mounted, the first annular seal carrier having a tapered exterior profile which engages a mating tapered profile on the first tubular member to non-rotatably couple the first annular seal carrier with the first tubular member;

ii. a second annular seal carrier on which a second seal ring is mounted, the second annular seal carrier having a tapered interior profile which engages a mating tapered profile on the second tubular member to non-rotatably couple the second annular seal carrier with the second tubular member;

iii. the second annular seal carrier including a first portion and a second portion, a plurality of axially extending pins extending between the first portion and the second portion such that the first portion and the second portion are non-rotatably coupled while retaining relative axial movement, a plurality of biasing springs being disposed between the first portion and the second portion, the biasing springs serving to maintain the second seal ring in sealing engagement with the first seal ring thereby forming a mechanical seal, the mechanical seal sealing a pressure differential between the pump end portion and the drill bit end portion of the sealed chamber; and e. the drill bit end portion of the sealed chamber having pressure relief means through which excess fluid is bled to the exterior of the first tubular member upon the pressure of fluid within the drill bit end portion of the sealed chamber exceeding a predetermined level, the pressure relief means being positioned in the pressure responsive drill bit end piston, the pressure responsive drill bit end piston including seals disposed in seal grooves that have stepped seal engaging end walls, such that the seals leak fluids to the exterior of the first tubular member at predetermined pressure levels.

* * * * *